US011460198B2

(12) United States Patent
Brabec et al.

(10) Patent No.: US 11,460,198 B2
(45) Date of Patent: Oct. 4, 2022

(54) BACKPLANE ADJUSTABLE HUMIDIFIER

(71) Applicant: Ademco Inc., Golden Valley, MN (US)

(72) Inventors: Jan Brabec, Letovice (CZ); Charles N. Hoff, Excelsior, MN (US)

(73) Assignee: Ademco Inc., Golden Valley, MN (US)

( * ) Notice: Subject to any disclaimer, the term of this patent is extended or adjusted under 35 U.S.C. 154(b) by 218 days.

(21) Appl. No.: 16/719,721

(22) Filed: Dec. 18, 2019

(65) Prior Publication Data

US 2021/0190340 A1 Jun. 24, 2021

(51) Int. Cl.

| | |
|---|---|
| ***F24F 3/14*** | (2006.01) |
| ***F24F 6/04*** | (2006.01) |
| ***F24F 13/32*** | (2006.01) |
| ***F24F 11/00*** | (2018.01) |
| ***F24F 1/035*** | (2019.01) |
| *F24F 110/20* | (2018.01) |
| *F24F 1/0073* | (2019.01) |

(52) U.S. Cl.

CPC ..... *F24F 6/04* (2013.01); *F24F 1/035* (2019.02); *F24F 3/14* (2013.01); *F24F 11/0008* (2013.01); *F24F 13/32* (2013.01); *F24F 1/0073* (2019.02); *F24F 2110/20* (2018.01)

(58) Field of Classification Search

None

See application file for complete search history.

(56) References Cited

U.S. PATENT DOCUMENTS 3,823,926 A * 7/1974 Bracich ..... F24F 6/04 261/106
5,295,903 A * 3/1994 Bolton ..... F24F 1/027 454/203
5,492,551 A * 2/1996 Wolfe ..... B01D 39/086 55/DIG. 39
5,968,217 A * 10/1999 Stein ..... B01D 46/10 55/DIG. 35
9,404,666 B2 * 8/2016 Terlson ..... F24F 6/04
2010/0300541 A1 * 12/2010 Carlay, II ..... F24F 13/0218 137/1
2011/0068490 A1 3/2011 Wang et al.
2013/0186611 A1 7/2013 Schneider et al.
2018/0274804 A1 * 9/2018 Kelly ..... B01D 53/83
2021/0140652 A1 * 5/2021 D'Souza ..... F24F 1/031

FOREIGN PATENT DOCUMENTS

CM 206131415 U 4/2017

* cited by examiner

*Primary Examiner* — Jerry-Daryl Fletcher

*Assistant Examiner* — Daniel C Comings

(74) *Attorney, Agent, or Firm* — Shumaker & Sieffert, P.A.

(57) ABSTRACT

A humidifier including a humidifier housing with an adjustable backplane configured to fit to a variety of humidifier pad sizes. Different sizes of humidifier pads are available, and the choice of humidifier pad may depend on the capacity of the HVAC system. The backplane of this disclosure may be adjusted by moving to one position to accommodate a larger humidifier pad or to a second position for a smaller humidifier pad. The backplane of the humidifier housing is configured to mount over an opening of an air duct of an HVAC system such that air is directed along an air path defined by the humidifier housing, through the humidifier pad positioned in front of the air duct and into the air stream of the HVAC system. Water flows through inlet tubing to a water distributor, which may direct the water to the top of the humidifier pad.

19 Claims, 5 Drawing Sheets

BACKPLANE ADJUSTABLE HUMIDIFIER

TECHNICAL FIELD

The disclosure relates to humidifiers for adding humidity to an inside space of a building structure.

BACKGROUND

In dry or cold climates, it may be useful to add moisture to the air inside enclosed spaces to maintain humidity levels. There are many products on the market employing a variety of techniques to increase such humidity levels. An example product includes evaporative humidifiers, designed to add moisture to the air of a heating, ventilation, and air conditioning (HVAC) system.

Some example evaporative humidifiers include a bypass evaporative humidifier. A bypass evaporative humidifier directs air from an air stream of the HVAC system, through a moistened humidifier pad, and back into an air stream of the HVAC system. Such humidifiers often include a housing mounted to the outside of an air duct, plenum, or the like of the HVAC system. The housing may include an internal cavity that houses the humidifier pad, an air inlet that directs an incoming air stream from the HVAC system to the humidifier pad, and an air outlet that directs a moistened air stream from the humidifier pad and into an air stream of the HVAC system.

Other example evaporative humidifiers include a fan-assisted humidifier. A fan-assisted humidifier uses a powered fan or blower to help force air from an air inlet to the air outlet and through the humidifier. In other humidifiers, a pressure differential created by the main circulating fan or blower of the HVAC system between the return air duct and the supply air duct is used to draw air from the supply air duct, through the humidifier pad of the humidifier, and to the return duct of the HVAC system.

SUMMARY

In general, this disclosure is directed to a humidifier including a humidifier housing with an adjustable backplane configured to fit to a variety of humidifier pad sizes. The backplane of the humidifier housing is configured to mount over an opening of an air duct of an HVAC system. The backplane includes a port that fits over and seals the opening in the air duct such that air is directed along an air path defined by the humidifier housing, through the humidifier pad positioned in front of the air duct and into the air stream of the HVAC system.

The humidifier housing includes a water distributor support mechanism that positions a water distributor above the humidifier pad. Water flows through inlet tubing to the water distributor, which directs the water to the top of the humidifier pad. Water flow through the inlet tubing may be controlled by an electronically controlled valve, such as a solenoid valve. A variety of different sizes of humidifier pads are available, and the choice of humidifier pad may depend on the capacity of the HVAC system. A higher capacity HVAC system supplying a large structure may use a large humidifier pad. A smaller capacity HVAC system may use a smaller humidifier pad. for supplying a smaller structure. The backplane of this disclosure may be adjusted to accommodate a variety of humidifier pad sizes, for example by moving to one position to accommodate a larger humidifier pad or to a second position for a smaller humidifier pad.

In one example, the disclosure is directed to a device configured to add moisture to an air stream of a heating, ventilation and air conditioning (HVAC) system, the device comprising: a housing that defines at least part of an air path, wherein the air path is configured to carry the moisture to the air stream of the HVAC system, comprising:

a water distributor support configured to: position a water distributor above a humidifier pad, wherein the air path flows through the humidifier pad into the air stream; a backplane comprising: an adjustable frame comprising a fixed portion and a movable portion that define a port through which the air path carries the moisture to the air stream; wherein the movable portion is configured to move such that moving the movable portion in a first direction causes a first dimension of the adjustable frame to decrease and moving the movable portion in a second direction causes the first dimension of the adjustable frame to increase; wherein the backplane is configured to mount to an air duct of the HVAC system, wherein the air duct is configured to contain and direct the air stream.

In another example, the disclosure is directed to system configured to add moisture to an air stream of a heating, ventilation, and air conditioning (HVAC) system, the system comprising: a water distributor support configured to: position a water distributor above a humidifier pad, wherein the air path flows through the humidifier pad into the air stream; a backplane comprising: an adjustable frame comprising a fixed portion and a movable portion that define a port through which the air path carries the moisture to the air stream; wherein the movable portion is configured to move such that moving the movable portion in a first direction causes a first dimension of the adjustable frame to decrease and moving the movable portion in a second direction causes the first dimension of the adjustable frame to increase; wherein the backplane is configured to mount to an air duct of the HVAC system, wherein the air duct is configured to contain and direct the air stream.

In another example, the disclosure is directed to a method for adding moisture to an air stream of a heating, ventilation, and air conditioning (HVAC) system, the method comprising: mounting a backplane of a housing for a humidifier to an air duct of the HVAC system, wherein the housing defines at least part of an air path, and wherein the backplane comprises an adjustable frame comprising a fixed portion and a movable portion that define a port through which the air path carries the moisture to the air stream; moving the movable portion in a first direction to cause a first dimension of the adjustable frame to increase; inserting a humidifier pad into the adjustable frame, wherein the air path flows through the humidifier pad into the air stream; moving the movable portion in a second direction to cause the first dimension of the adjustable frame to decrease; positioning a water distributor above a humidifier pad; moistening the humidifier pad with water distributed by the water distributer; flowing the air through the moistened humidifier pad; evaporating the water in the humidifier pad into the air path, directing the air path with the evaporated water to the air stream of the HVAC system.

The details of one or more examples of the disclosure are set forth in the accompanying drawings and the description below. Other features, objects, and advantages of the disclosure will be apparent from the description and drawings, and from the claims.

DETAILED DESCRIPTION

This disclosure is directed to an evaporative humidifier including a humidifier housing with an adjustable backplane configured to fit to a variety of humidifier pad sizes. The backplane of the humidifier housing is configured to mount over an opening of an air duct of an HVAC system. The backplane includes a port that fits over and seals the opening in the air duct such that air is directed along an air path defined by the humidifier housing, through the humidifier pad positioned in the air path and introduced into the air stream of the HVAC system.

Evaporative humidifiers, in contrast to steam or other types of humidifiers, may direct air from an air stream of an HVAC system through a moistened humidifier pad. The humidifier pad may be replaceable. Air passing through the pad picks up moisture by evaporating water applied to the pad. The water may applied by a water distributor on top of the pad. Humidifiers may be designed to supply a specific amount of moisture to the air and sized to accommodate the capacity of a HVAC system to which the humidifier would be attached. Accordingly, the replaceable humidifier pad may be sized for the designed capacity of the HVAC system. For example, a smaller building may require a lower capacity humidifier which uses a smaller humidifier pad while a larger building may require a relatively larger capacity humidifier using a larger humidifier pad.

The return air duct is on the inlet side of a distribution blower of the HVAC system. In the example of a bypass humidifier, the lower pressure of the inlet side of the distribution blower compared to the pressure in the supply duct provides a suction to help draw air from the humidifier air path into the HVAC system air stream.

Figure 1:
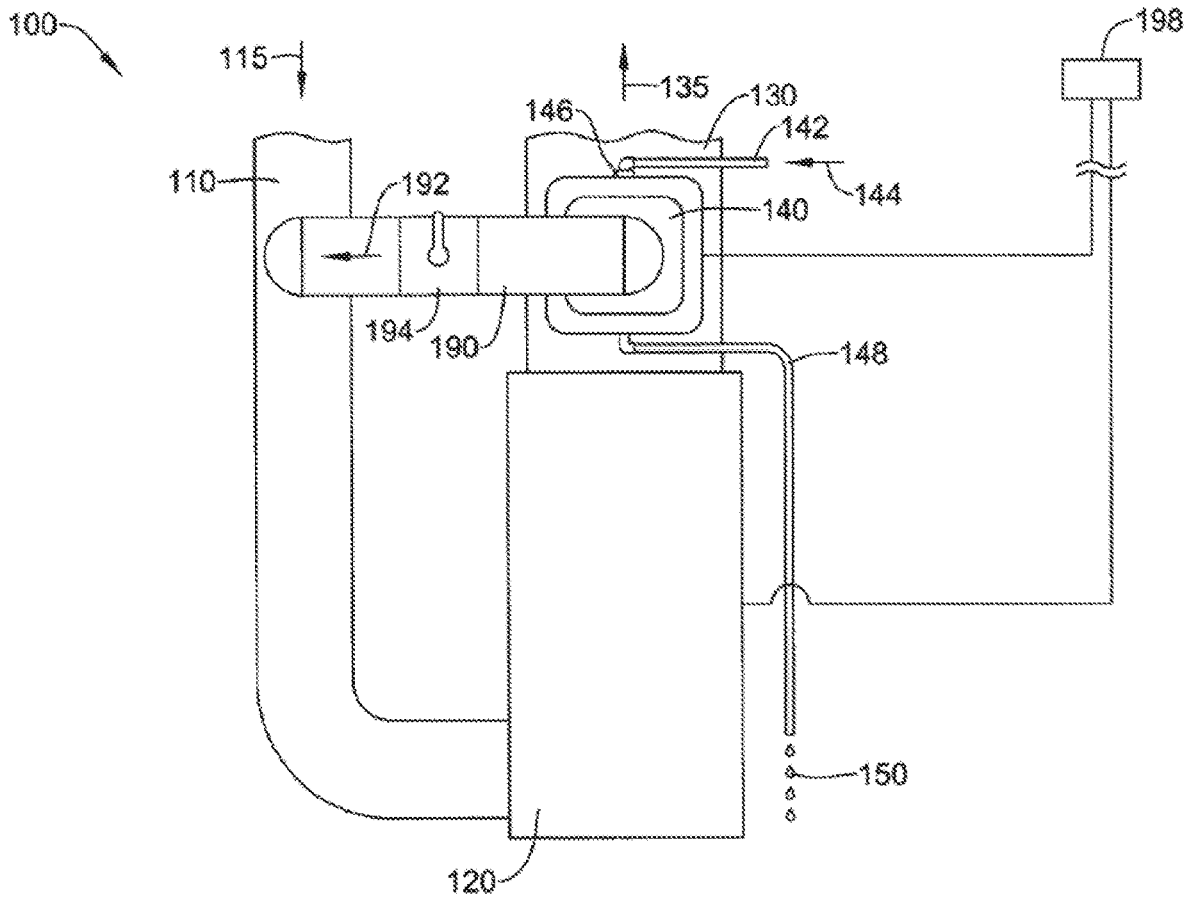
FIG. 1 is a schematic diagram showing a portion of an example forced air HVAC system and an illustrative bypass humidifier.

FIG. 1 is a schematic diagram showing a portion of an example forced air HVAC system 100 and an example bypass humidifier 140. The schematic diagram of FIG. 1 uses graphic symbols as a representation of the system rather than realistic pictures. The example of forced air HVAC system 100 is an up-flow type, but any suitable forced air HVAC system 100 may be used (e.g., down-flow, horizontal-flow, lowboy, highboy, etc.). In example HVAC system 100, return air duct 110 delivers return air 115 from a conditioned air space to cabinet 120. Cabinet 120 may enclose an air handler, blower, or air-handling fan (not shown in FIG. 1), that when activated pulls air from the enclosed space via the return air duct 110, and delivers conditioned air 135 to the enclosed spaced via a supply air duct 130.

The illustrative cabinet 120 may include components to help condition the return air 115 before supplying it to the conditioned air space via the supply air duct 130. For example, cabinet 120 may include one or more filters (not shown in FIG. 1) for removing particulates and/or other contaminants from the return air 115. In some examples, cabinet 120 may include a humidifier, a heat exchanger, such as a gas burner, an electric resistance heating element, an evaporator and/or condenser coil, and/or any other type of heat exchanger (not shown in FIG. 1).

In FIG. 1, HVAC system 100 is shown with an example bypass type humidifier 140. Humidifier 140 includes a housing that is attached to the supply duct 130. The housing of humidifier 140 defines at least part of an air path of HVAC system 100. Part of the air path is defined by a hole (not shown in FIG. 1) cut through the wall of supply duct 130. A backplane of the housing of humidifier 140 is mounted to supply duct 130 over the hole. The backplane of humidifier seals the hole in supply duct 130 to define at least part of an air path of HVAC system 100.

In this disclosure "air path" is used to refer to the path that air takes moving through the components of the humidifier. The term "air stream" is used to refer to the route and the air moving along the route of the HVAC system, not including the "air path." Thus, the "air stream" includes air moving through return duct 110 (e.g. return air 115), through components of cabinet 120 and out supply duct 130, e.g. conditioned air 135. In contrast, the "air path" refers to the route defined, for example, by the humidifier 140 housing and bypass duct 190. In the example of FIG. 1, air is removed from the air stream in cabinet 120 into and humidified air from the air path is returned to the air stream at return duct 110 through bypass duct 190.

The housing of humidifier 140, as shown in FIG. 1, includes an air outlet port (not shown in FIG. 1). A bypass duct 190 is coupled between the air outlet port of the housing and return air duct 110. In this configuration, and when the air-handling fan (not shown, but included in cabinet 120) of the HVAC system 100 is ON, bypass air 192 flows from supply duct 130, through humidifier 140 to pick up moisture, through bypass duct 190 to return duct 110, driven at least in part by a pressure difference between supply duct 130 and return duct 110. The pressure difference between the air ducts 130, 110 may be generated by the air-handling fan or other component included in cabinet 120. In some examples, a bypass damper 194 may be included in bypass duct 190 and may be adjusted to selectively block or unblock (i.e., not allow or allow) the flow of bypass air 192 through bypass duct 190. In some examples, instead of mounting bypass humidifier 140 housing to supply duct 130, it may be mounted to return duct 110. In such examples, bypass air 192 flows from supply duct 130, through bypass duct 190, through humidifier 140 to pick up moisture, then to return duct 110. As in the previous example, the flow of bypass air 192 may be driven from supply air duct 130 through bypass duct 190 to return duct 110 via the pressure difference therebetween.

Figure 2:
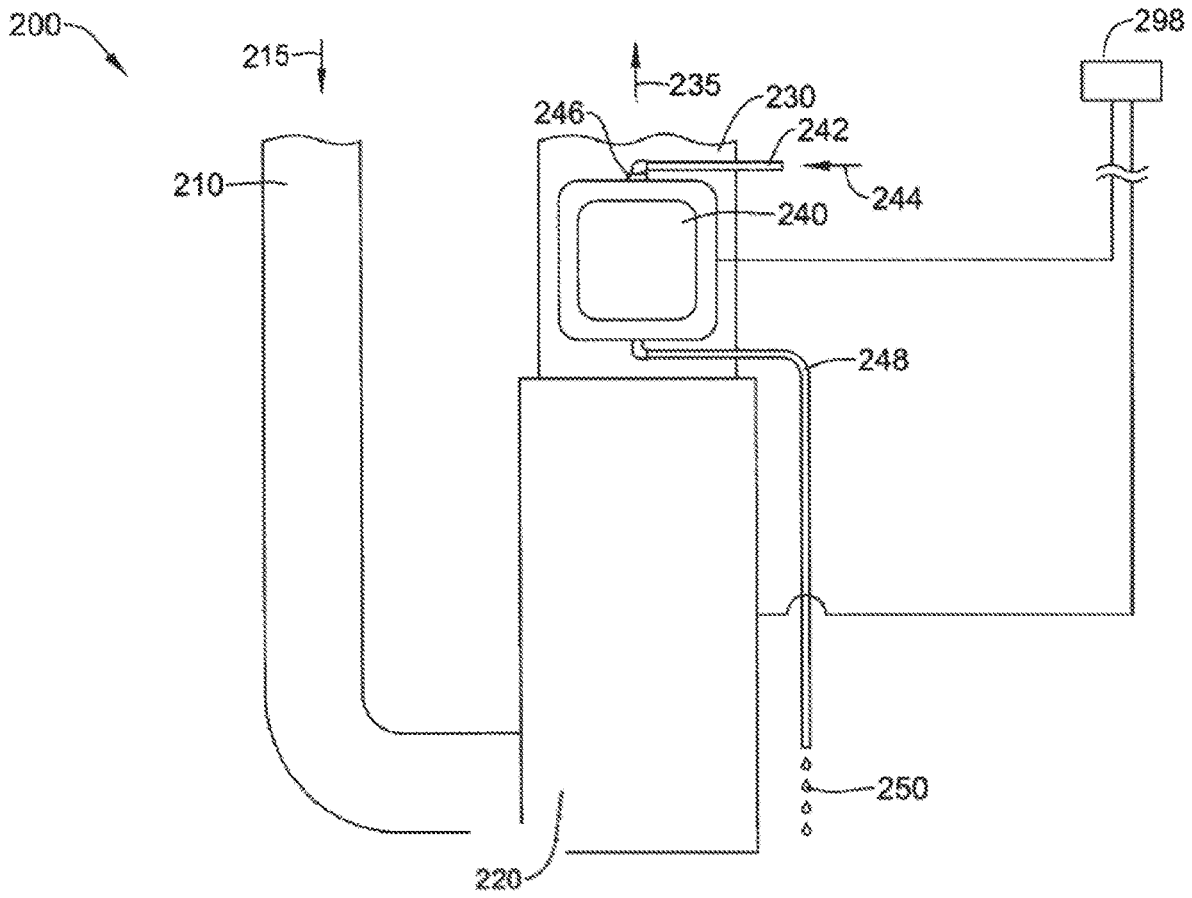
FIG. 2 is a schematic diagram showing a portion of an example forced air HVAC system and an illustrative fan-assisted humidifier.

Bypass humidifier 140, as shown in FIG. 1, is coupled to a water source 142 that supplies water 144 to humidifier 140. A water source control valve 146 (e.g., a solenoid water valve) may be included to control the flow of water 144 from water source 142 to humidifier 140. When flowing, water 144 is provided to a humidifier pad (not illustrated in FIG. 1) within humidifier 140, to moisten the humidifier pad. In the example of FIG. 2 the water 144 flows from the top to the bottom (e.g., the direction of gravity). Humidifier 140 is configured such that bypass air 192 flowing from supply air duct 130 to return duct 110 via bypass duct 190 must flow through the moistened humidifier pad. The flow of bypass air 192 in the air path is configured to evaporate some of the moisture from the humidifier pad. Evaporation of at least some of the water from the moistened humidifier pad may therefore impart humidity to bypass air 192. Not all of water 144 provided to the humidifier pad may be evaporated by bypass air 192. Some of the water 144 provided to the humidifier pad may reach the bottom of the humidifier pad. The excess water 150 may be collected by a collection tray, routed, and expelled to a drain of the building via a water drain pipe 148.

HVAC system 100 may include an HVAC controller 198. HVAC controller 198 may be configured to control one or more components of HVAC system 100. In some examples, HVAC controller 198 may control the flow of water 144 to the humidifier pad of humidifier 140 and may control bypass damper 194 to control the flow of bypass air 192 through bypass duct 190. Controller 198 may control other components (e.g., air handler, blower, or air-handling fan) included in cabinet 120 to control the flow of return air 115 and/or conditioned air 135.

Controller 198 may include processing circuitry. Examples of processing circuitry in controller 198 may include any one or more of a microcontroller (MCU), e.g. a computer on a single integrated circuit containing a processor core, memory, and programmable input/output peripherals, a microprocessor (μP), e.g. a central processing unit (CPU) on a single integrated circuit (IC), a controller, a digital signal processor (DSP), an application specific integrated circuit (ASIC), a field-programmable gate array (FPGA), a system on chip (SoC) or equivalent discrete or integrated logic circuitry. A processor may be integrated circuitry, i.e., integrated processing circuitry, and that the integrated processing circuitry may be realized as fixed hardware processing circuitry, programmable processing circuitry and/or a combination of both fixed and programmable processing circuitry. Accordingly, the terms "processing circuitry," "processor" or "controller," as used herein, may refer to any one or more of the foregoing structures or any other structure operable to perform techniques described herein.

Humidifier 140 of this disclosure may provide advantages over other types of evaporative humidifiers that are configured to use only a specific size of humidifier pad. For example, the single humidifier housing may be configured support a variety of humidifier pads and therefore the single humidifier housing may be used with a variety of HVAC systems. Therefore, an installer need only carry one style of humidifier, which tends to be somewhat bulky and takes up space on an HVAC technician's vehicle. The single style of humidifier avoids the need to carry several styles to accommodate the variety of HVAC systems with different capacities, providing more space for other repair parts, tools and equipment.

FIG. 2 is a schematic diagram showing a portion of an example forced air HVAC system 200 and an illustrative fan-assisted humidifier 240. Components in FIG. 2 that include reference numerals which share the final two digits as the reference numerals for components in FIG. 1 can be assumed to function similarly. For example, humidifier 140 and humidifier 240 are both configured to impart humidity into flowing air. Similarly, return air duct 110 and return air duct 210 are both configured to draw air from the building for conditioning. HVAC system 200 differs from HVAC system 100 by including a fan-assisted humidifier 240, rather than a bypass humidifier 140. Instead of using a pressure difference between supply air duct 230 and return air duct 210, humidifier 240 uses a fan included in the housing of humidifier 240 to drive the airflow in the air path.

As discussed previously with respect to FIG. 1, HVAC system 200 may include a controller 298. Controller 298 may control one or more components included in HVAC system 200. In some examples, controller 298 may control components including, but are not limited to, an air handler, blower, or air-handling fan, a humidifier, a heat exchanger, such as a gas burner, an electric resistance heating element, an evaporator and/or condenser coil, and/or any other type of air conditioning component.

In the example of FIG. 2, fan-assisted humidifier 240 is shown attached to supply air duct 230. However, in some examples, fan-assisted humidifier 240 may be attached to return duct 210 or any other suitable location where it may be fluidically connected with HVAC air stream. The location of humidifier 240 does not limit the techniques of this disclosure.

As described with respect to humidifier 140, humidifier 240 of FIG. 2 may be coupled to a water source 242 that supplies water 244 to the humidifier pad of the humidifier 240 through a water source control valve 246. Some of the water provided to the humidifier pad may reach the bottom of the humidifier pad. This water 250 may be collected by a collection tray and routed and expelled to a drain of the building by a water drain pipe 248.

As shown, HVAC system 200 draws return air 215 into the HVAC air stream from the building through return duct 210. The air then flows through cabinet 220, where it may pass through a filter to remove particulates or other air contaminants (not shown in FIG. 2). Conditioned supply air 235 (e.g. heated, cooled, humidified, filtered, and similar conditioning) then flows through supply duct 230 and back to the rooms and other spaces of the building.

Fan-assisted humidifier 240, as shown in FIG. 2, defines at least part of the air path of supply duct 230. In some examples, fan-assisted humidifier 240 may be configured to draw a portion of supply air 235 from the HVAC air stream via a first hole cut into the walls supply air duct 230. The portion of supply air may enter the air path of humidifier 240 through an air intake (not shown) of humidifier 240 sealed to the first hole. Because humidifier 240 does not have a pressure differential, as described above in relation to humidifier 140 in FIG. 1, humidifier 240 may be configured to draw a portion of supply air under the influence of a humidifier fan or blower (not shown in FIG. 2). After drawing a portion of supply air 235 from supply duct 230, humidifier 240 passes the air through a moistened humidifier pad (not shown in FIG. 2) that is part of the air path of humidifier 240. As a portion of supply air 235 passes through the moistened humidifier pad, the air may evaporate some of the moisture imparted to the humidifier pad, and carry the moisture through the remainder of the air path of humidifier 240. Humidifier 240 may then return the moistened air back into the air stream of supply duct 230 via an air outlet port and a second hole cut into the walls of supply duct 230 (not shown in FIG. 2).

In some examples, fan-assisted humidifier 240 may be mounted to return duct 210 rather than supply duct 230 (not shown in FIG. 2). In such examples, return duct 210 includes a first hole to allow some of the return air 215 to pass from the air stream through air path of humidifier 240. Humidifier 240 may draw a portion of return air 215 through a moistened humidifier pad using the included humidifier fan. After imparting moisture into a portion of return air 215, humidifier 240 may return the moistened air back into return air duct 210 through a second hole cut into the walls of return air duct 210 (not shown in FIG. 2).

In some examples, fan-assisted humidifier 240 may draw air from the ambient surroundings. Instead of drawing air from either supply duct 230 or return duct 210, humidifier 240 may use the included humidifier fan to draw air from the air surrounding cabinet 220, for example. In such examples, the air may be drawn from the area where HVAC system 200 is installed (e.g., a basement, attic, closet of the building). In other examples, HVAC system 200 may include another duct (not shown in FIG. 2) to draw air into humidifier 240 from another location, such as from an air exchanger system, or directly from air external to the building. Humidifier 240 may draw air into the air path using the included humidifier fan and then moisten the air by passing the air in the air path through the moistened humidifier pad. Humidifier 240 may then merge the moistened air via an outlet duct into the air stream, for example with supply air 235 in examples when mounted to supply duct 230 or merge the moistened air with return air 215 in examples when humidifier 240 is mounted to return duct 110.

As described by the previous examples, there are many configurations for evaporative humidifiers included in HVAC systems. Depending on which air duct the humidifier is mounted to, there may be variations in the humidifier housing.

In some examples, the present disclosure provides humidifiers with new configurations of humidifier components. While some features may be shown and/or discussed in association with either a bypass type humidifier or a fan powered humidifier, such features may be used with either type of humidifier when compatible.

Figure 3:
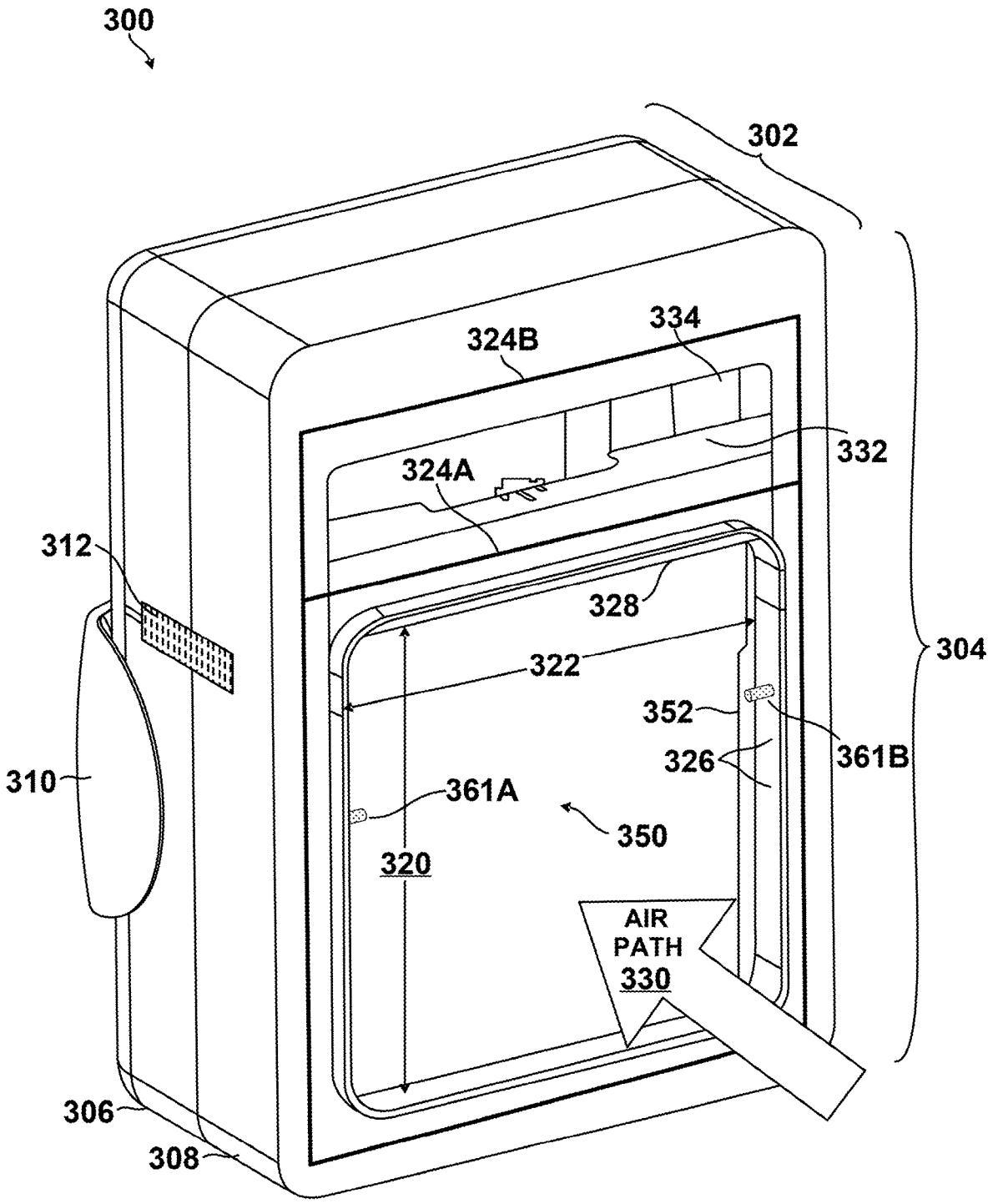
FIG. 3 is a conceptual diagram illustrating an example evaporative humidifier of this disclosure.

FIG. 3 is a conceptual diagram illustrating an example evaporative humidifier of this disclosure. Humidifier 300 is an example of humidifier 140 and 240 described above in relation to FIGS. 1 and 2.

In the example of FIG. 3, humidifier 300 includes a housing 302 with a backplane 304. Portions of backplane 304 may be adjustable, as described above in relation to FIGS. 1 and 2. In some examples, housing 302 may include one or more portions 306 and 308 held together with one or more clasps 312. Duct connection 310 is mounted to the front portion 306 of housing 302. Humidifier pad 350 may be held in place in housing 302 by one or more humidifier pad retainers 352. Backplane 304 includes an adjustable frame with a fixed portion 326 and a movable portion 328. Movable portion 328 may be adjusted in the first dimension 320. The frame defines an opening with a second dimension 322 perpendicular to the first dimension 320. The frame may be aligned with a hole in a duct of an HVAC system, such as a hole cut into the walls for supply duct 230 described above in relation to FIG. 2.

In some examples, movable portion 328 may include a water distributor 332, which is positioned above humidifier pad 350, with respect to gravity. In other examples, water distributor 332 may be a separate component that is attached to movable portion 328 of the frame. Water distributor 332 may include a clamp or similar retaining device to hold water tubing, such as tubing connected to a water source control valve, such as water source control valve 246 described above in relation to FIG. 2. Water distributor 332 may include one or more holes, slits, channels or similar features to receive water from the water source control valve and distribute the water to drip down through humidifier pad 350.

As described above in relation to FIGS. 1 and 2, movable portion 328 may slide up or down in the first dimension 320 to accommodate different sized humidifier pads 350. In other words, the first dimension of the adjustable frame is based on a first dimension of the humidifier pad and may adjust a distance between the movable portion and the fixed portion based on a first dimension of the humidifier pad. Movable portion 328 and/or housing 302 may include snaps, clips, pins or other complementary engageable structures 361A and 361B, configured to engage with the one or more engageable structures of the movable portion to hold the movable portion of the adjustable frame at a selectable position relative to the fixed portion and housing 302. The dimensions of the pad may impact an amount of moisture carried by the air path, e.g. a larger humidifier pad may be able to deliver more volume per unit time (e.g. liters per hour) to the air path than a smaller humidifier pad.

In some examples, fixed portion 326 may include removable spacers that may snap in or otherwise attach to the frame to accommodate humidifier pads with a variety of sizes in the second dimension 322. In other words, the removable spacers may be considered internal structures configured to adjust the second dimension of the adjustable frame based on a second dimension of the humidifier pad Housing 302 may include additional humidifier pad retainers 352 inside the housing (not shown in FIG. 3) to secure humidifier pad 350 in place in the housing.

In operation, backplane 304 may be mounted to either a supply duct or return duct of an HVAC system. The frame, comprising fixed portion 326 and movable portion 328 may align with a hole in the duct. In the example of a bypass configuration with backplane 304 mounted to a supply duct, the higher pressure of the supply duct compared to the return duct may cause air from the HVAC air stream to enter air path 330 as shown in FIG. 3. The air in air path 330 passes through humidifier pad 350, through housing 302 and into a bypass duct connected to duct connection 310, as described above in relation to FIGS. 1 and 2. The opening defined by the frame may be considered an inlet port. When the water supply valve allows water into water distributor 332, the water moistens humidifier pad 350 and air in air path 330 picks up moisture and carries the moisture back into the HVAC air stream via the bypass duct. Duct connection 310 may be considered an outlet port.

In other examples, when backplane 304 is mounted to the return duct and a bypass duct is mounted to the supply duct, the higher pressure in the supply duct may cause air to flow in air path 330 in the opposite direction from that shown in FIG. 3. The opening defined by the frame may be considered an outlet port and duct connection 310 may be considered an inlet port. Either configuration may be advantageous depending on the space available in the space in which the HVAC system is located.

In other examples, both backplane 304 and a duct connected to duct connection 310 may be connected to the supply duct. Similarly, both backplane 304 and a duct connected to duct connection 310 may be connected to the supply duct. The inlet port and the outlet port may depend in the direction the humidifier blower is configured to move the air in air path 330.

In some examples the frame (326 and 328) may form a seal with the hole in the duct to which the backplane is mounted. In some examples, humidifier 300 may also include a gasket 324A and 324B. In this manner the backplane is configured to create an air-tight seal to a port of the air duct such that the air in air path 330 must flow through the humidifier pad 350 into the air stream. In some examples installing a humidifier pad 350 that is smaller than the housing in the first dimension 320 may leave a gap 334 above movable portion 328. To prevent air from escaping through gap 334, the hole in the duct to which backplane 304 is attached may be sized to fit closely to the first dimension 320 and second dimension 322 of the frame. In this manner air flows between air path 330 and the air stream of the HVAC without leaking through gap 334.

The example of FIG. 3 depicts a front portion 306 and a back portion 308 of housing 302. In some examples the front portion 306 and back portion 308 may be held together by one or more clasps 312. Back portion 308, which includes back plane 304 may also be considered as fixed portion 308 when backplane 304 is mounted to a duct. Front portion 306 may be considered as removable portion 306. In some examples front portion 306 may be removed to inspect or replace components of humidifier 300, such as replace the humidifier pad 350. In some examples the removable portion of front housing 306 may not include all of front housing 306. For example, only the top portion of front housing 306 may be configured to be removable.

Figure 4:
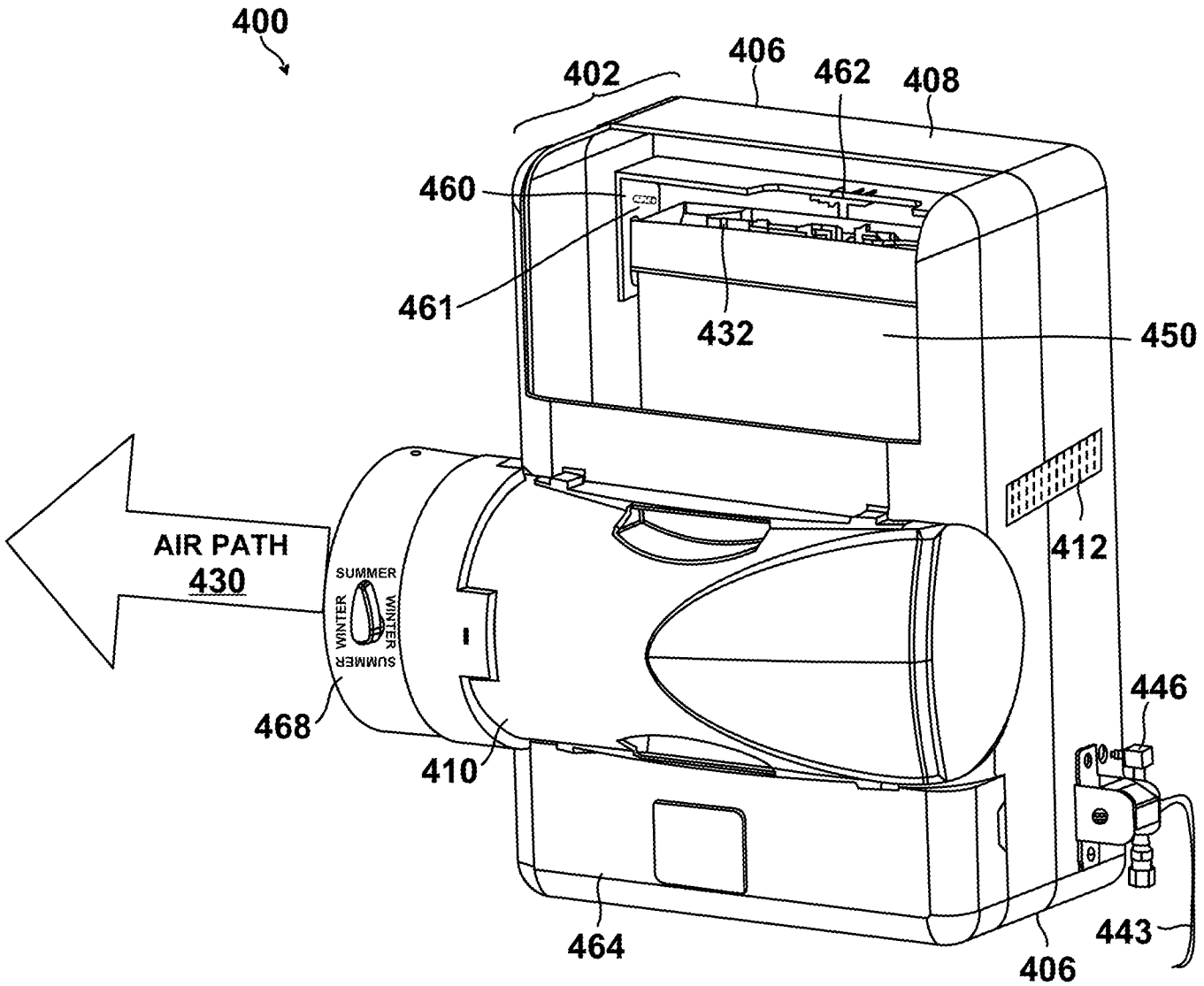
FIG. 4 is a conceptual diagram illustrating a front cutaway view of an example humidifier according to one or more techniques of this disclosure.

FIG. 4 is a conceptual diagram illustrating a front cutaway view of an example humidifier according to one or more techniques of this disclosure. Humidifier 400 is an example of humidifier 140 and 240 described above in relation to FIGS. 1 and 2.

In the example of FIG. 4, humidifier 400 includes a housing 402 with a backplane 404. Portions of backplane 404 may be adjustable, as described above in relation to FIGS. 1-3. In some examples, housing 402 may include one or more portions 406 and 408 held together with one or more clasps 412 as described above in relation to FIG. 3. The example of humidifier 400 also includes water distributer 432, water distributor support 460 with nozzles 462, humidifier pad 450, duct connection 410, bypass damper 468, water valve 446 with control wires 443. Water valve 446 may be connected by tubing to nozzles 462 as well as to a water source, such as water source 242 described above in relation to FIG. 2 (not shown in FIG. 4).

In some examples, humidifier 400 may include electronics 464, which may include processing circuitry, one or more sensors and other components. In some examples, electronics 464 may be configured to sense the temperature, humidity, or other aspects of air path 430 and the operation of humidifier 400. In some examples electronics 464 may be operatively coupled to an HVAC controller, such as HVAC controller 198 described above in relation to FIG. 1. Electronics 464 may be configured to control one or more components of humidifier 400, such as water valve 446, bypass damper 468, a humidifier fan or other components (not shown in FIG. 4).

Duct connection 410 is mounted to the front portion 346 of housing 402. Duct connection 410 may include bypass damper 468 configured to allow or prevent air from passing through duct connection 410. For example, in some regions, summer may be humid and adding moisture to the air in summer may be undesirable. Therefore bypass damper 468 may be adjusted to prevent air from passing through air path 430 of humidifier 400 to and from the air stream of the HVAC system. In the winter, when air may be dry, bypass damper 468 may be adjusted to allow humidified air from air path 430 to pass to the air stream of the HVAC system. In some examples bypass damper 468 may be manually controlled. In other examples bypass damper 468 may be controlled by a motor to automatically open and shut bypass damper 468 for example controlled by electronics 464.

Humidifier pad 450 may be held in place in housing 402 by one or more humidifier pad retainers as described above in relation to humidifier pad 350 in FIG. 3. Backplane 404 includes an adjustable frame with a fixed portion and a movable portion that includes water distributor support 460 and water distributor 432, and one or more complementary engageable structures 461, as described above in relation to movable portion 328 in FIG. 3. In the example of FIG. 4, humidifier pad 450 is larger in the first dimension when compared to humidifier pad 350 depicted in FIG. 3. Humidifier pad 450 fills the space available in backplane 404 for a humidifier pad and therefore does not leave a gap, such as gap 334 described above in relation to FIG. 3.

Figure 5:
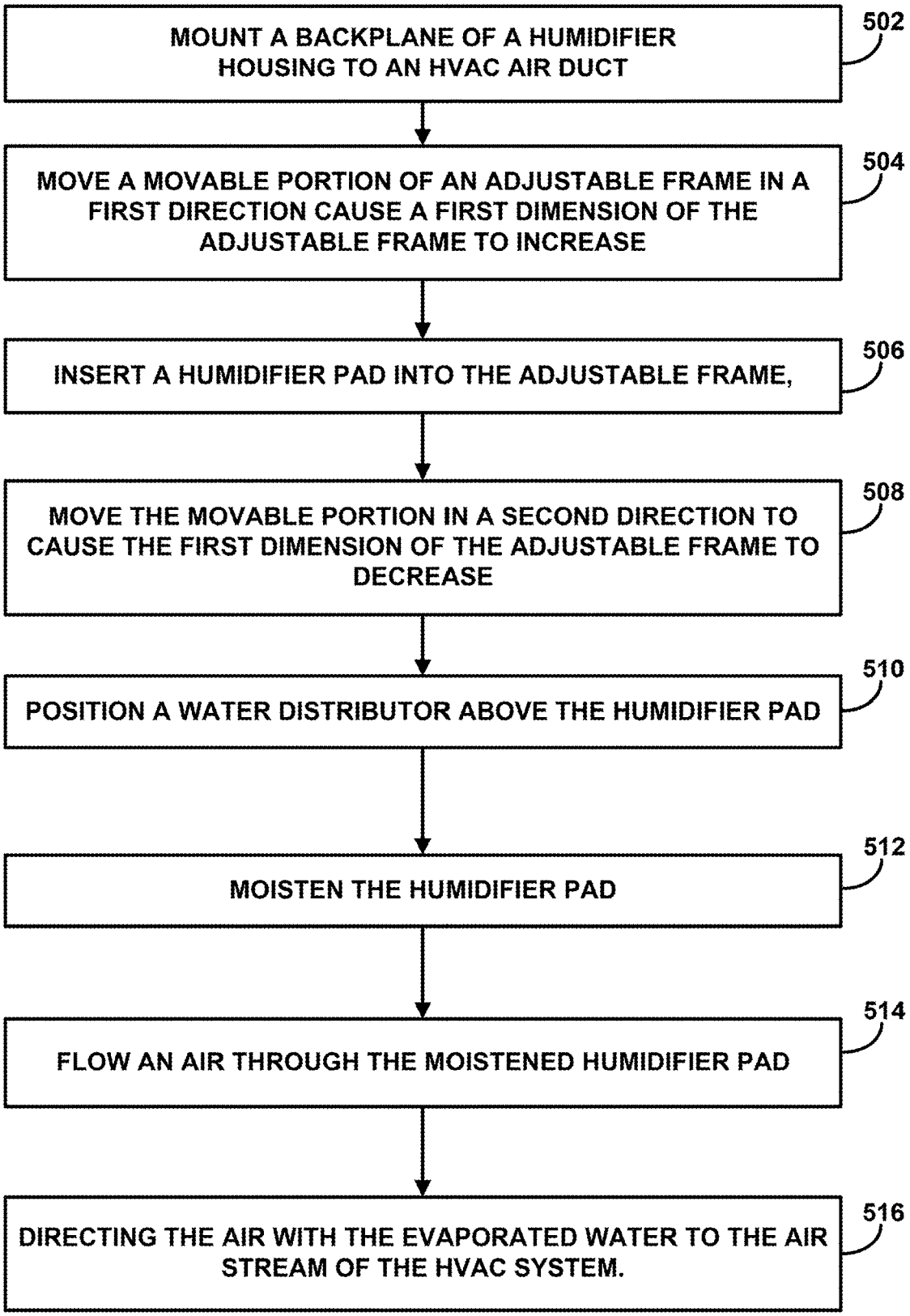
FIG. 5 is a flow diagram illustrating an example operation of the adjustable backplane humidifier of this disclosure.

FIG. 5 is a flow diagram illustrating an example operation of the adjustable backplane humidifier of this disclosure. The blocks in FIG. 5 will be described in terms of FIGS. 1 and 3, unless otherwise noted.

An installer may mount backplane 304 of housing 302 for humidifier 300 to supply air duct 130 of HVAC system 100 (502). Housing 302 defines at least part of air path 330, which also includes the inlet port, humidifier pad 350 and the outlet port. As described above in relation to FIG. 3, the inlet port and the outlet port depend on which duct to which backplane 304 is mounted. Backplane 304 includes an adjustable frame comprising fixed portion 326 and movable portion 328 that define the inlet port, or outlet port, through which air path 330 carries the moisture evaporated from humidifier pad 350 to the air stream.

To install a humidifier pad appropriate for the particular HVAC system, an installer, or other user, may remove the front portion 306 of housing 302 by adjusting, e.g. twisting, unsnapping, pressing, and so on, clasp 312. Then move movable portion 328 in a first direction to cause a first dimension 320 of the adjustable frame to increase (504).

Once the adjustable frame has opened enough, the installer may insert humidifier pad 350 into the adjustable frame (506) and in some examples, lock humidifier pad 350 into place with one or more humidifier pad retainers 352. The installer may then move movable portion 328 in a second, e.g. downward direction to cause first dimension 320 of the adjustable frame to decrease (508). In some examples, moving the moving portion 328 downward may leave a gap 334. However, because the opening defined by the adjustable frame may be sized to fit closely within the opening of the HVAC duct, the air will still follow air path 330. Gaskets 324A and 324B may be included to further provide an air-tight seal between backplane 304 and the HVAC duct.

In some examples, positioning water distributor 332 above a humidifier pad (510) may be a separate step. In other examples, water distributor 332 may be a part of movable portion 328 and adjusting movable portion 328 may move water distributor 332 as well. In some examples, humidifier 300 may also include a water distributor support 460 device, as described above in relation to FIG. 4.

Water source control valve 146 may allow water 144 from water source 142 to flow through nozzles onto water distributor 332 to drip down and moisten humidifier pad 350 (512). Air in air path 330 may flow through the moistened humidifier pad (514) and evaporate some of the water, thereby humidifying the air in air path 330. The housing and ducts that form air path 330 may direct the air with the evaporated water to the air stream of the HVAC system (516).

Various examples of the disclosure have been described. These and other examples are within the scope of the following claims.

The invention claimed is:

1. A device configured to add moisture to an air stream of a heating, ventilation and air conditioning (HVAC) system, the device comprising:

a housing that defines at least part of an air path, wherein the air path is configured to carry the moisture to the air stream of the HVAC system, the housing comprising:

a water distributor support configured to:

position a water distributor adjacent to a humidifier pad, wherein the air path flows through the humidifier pad into the air stream;

a backplane comprising an adjustable frame comprising both a fixed portion and a movable portion, wherein the fixed portion defines a first port in the backplane;

wherein the movable portion comprises the water distributor support;

wherein the movable portion is configured to slide along the backplane and within the first port;

wherein both the fixed portion, and the movable portion together define a second port within the first port through which the air path carries the moisture to the air stream;

wherein the movable portion is configured to slide along the backplane, such that sliding the movable portion in a first direction causes a first dimension of the adjustable frame and an area of the second port to decrease and sliding the movable portion in a second direction causes the first dimension of the adjustable frame and the area of the second port to increase;

wherein the backplane is configured to mount to an air duct of the HVAC system, and wherein the air duct is configured to contain and direct the air stream.

2. The device of claim 1, wherein the first dimension of the adjustable frame is based on a first dimension of the humidifier pad.

3. The device of claim 2, wherein the adjustable frame comprises internal structures configured to adjust a second dimension of the adjustable frame based on a second dimension of the humidifier pad, wherein the second dimension of the adjustable frame is perpendicular to the first dimension along the backplane.

4. The device of claim 1, wherein the housing further comprises a humidifier pad retainer configured to secure the humidifier pad in the housing.

5. The device of claim 1, wherein the backplane is configured to create an air-tight seal to the air duct such that the air path must flow through the humidifier pad into the air stream.

6. The device of claim 1, wherein the movable portion of the adjustable frame comprises one or more complementary engageable structures configured to engage with the fixed portion and hold the movable portion at a selectable position relative to the fixed portion, and wherein the complementary engageable structures comprise any one or more of snaps, clips, or pins.

7. The device of claim 1, comprising a fan-assisted humidifier configured to drive airflow in the air path.

8. The device of claim 1, further comprising an outlet port separate from the first port and the second port, the outlet port configured to direct air in the air path to a second air duct of the HVAC system.

9. The device of claim 1, wherein the second port is an inlet port configured to direct air in the air path to the humidifier pad.

10. The device of claim 1, wherein the first dimension of the adjustable frame is configured to adjust an amount of moisture carried by the air path.

11. The device of claim 1, wherein the backplane is mounted to a supply air duct of the HVAC system.

12. A system configured to add moisture to an air stream of a heating, ventilation, and air conditioning (HVAC) system, the system comprising:

a housing that defines an air path;

a water distributor support configured to:

position a water distributor adjacent to a humidifier pad, wherein air in the air path flows through the humidifier pad, and into the air stream;

a backplane comprising an adjustable frame comprising both a fixed portion and a movable portion, wherein the fixed portion defines a first port in the backplane;

wherein the movable portion comprises the water distributor support;

wherein the movable portion is configured to slide along the backplane, and within the first port;

wherein both the fixed portion, and the movable portion that define a second port within the first port through which the air path carries the moisture to the air stream;

wherein the movable portion is configured to slide along the backplane, such that sliding the movable portion in a first direction causes a first dimension and an area of the second port of the adjustable frame to decrease and sliding the movable portion in a second direction causes the first dimension and the area of the second port of the adjustable frame to increase;

wherein the backplane is configured to mount to an air duct of the HVAC system, and wherein the air duct is configured to contain and direct the air stream.

13. The system of claim 12, further comprising a controller for controlling an amount of water distributed to the humidifier pad.

14. The system of claim 12, wherein the air duct is a first air duct, the system further comprising:

a second air duct, wherein the air path carries air from the second air duct to the first air duct.

15. The system of claim 14, further comprising a fan-assisted humidifier configured to drive airflow in the air path.

16. The system of claim 15, further comprising a controller configured to control the operation of the fan-assisted humidifier.

17. A method for adding moisture to an air stream of a heating, ventilation, and air conditioning (HVAC) system, the method comprising:

mounting a backplane of a housing for a humidifier to an air duct of the HVAC system, wherein the housing defines at least part of an air path, and wherein the backplane comprises an adjustable frame comprising both a fixed portion and a movable portion:

wherein the fixed portion defines a first port in the backplane;

wherein the movable portion is configured to slide along the backplane, and within the first port;

wherein both the fixed portion, and the movable portion together define a second port within the first port through which the air path carries the moisture to the air stream, wherein the movable portion comprises a water distributor positioned adjacent to the second port;

sliding the movable portion in a first direction along the backplane to cause a first dimension of the adjustable frame and an area of the second port to increase;

inserting a humidifier pad into the adjustable frame, wherein the air path flows through the humidifier pad into the air stream;

sliding the movable portion in a second direction along the backplane to cause the first dimension of the adjustable frame and the area of the second port to decrease;

moistening the humidifier pad with water distributed by the water distributer;

flowing the air through the moistened humidifier pad;

evaporating the water in the humidifier pad into the air path; and directing the air path with the evaporated water to the air stream of the HVAC system.

18. The method of claim 17, wherein moving sliding the movable portion comprises adjusting the area of the second port based on a first dimension of the humidifier pad.

19. The method of claim 17, further comprising adjusting internal structures of the fixed portion based on a second dimension of the humidifier pad.

* * * * *